US009888552B2

(12) United States Patent
Kang et al.

(10) Patent No.: US 9,888,552 B2
(45) Date of Patent: Feb. 6, 2018

(54) DETECTING CIRCUIT FOR SHORT OF LED ARRAY AND LED DRIVING APPARATUS USING THE SAME

(71) Applicant: Magnachip Semiconductor, Ltd., Cheongju-si (KR)

(72) Inventors: Tae-kyoung Kang, Cheongju-si (KR); Gyu-ho Lim, Cheongju-si (KR); Beom-seon Ryu, Cheongju-si (KR); Jun-sik Min, Cheongju-si (KR)

(73) Assignee: Magnachip Semiconductor, Ltd., Cheongju-si (KR)

( * ) Notice: Subject to any disclaimer, the term of this patent is extended or adjusted under 35 U.S.C. 154(b) by 54 days.

(21) Appl. No.: 13/693,241

(22) Filed: Dec. 4, 2012

(65) Prior Publication Data

US 2013/0147361 A1 Jun. 13, 2013

(30) Foreign Application Priority Data

Dec. 7, 2011 (KR) ..... 10-2011-0130485

(51) Int. Cl.
*H05B 37/03* (2006.01)
*H05B 33/08* (2006.01)

(52) U.S. Cl.
CPC ..... *H05B 37/036* (2013.01); *H05B 33/089* (2013.01)

(58) Field of Classification Search
CPC ..... H05B 33/0815; H05B 33/0818; H05B 33/0827; H05B 33/0851; H05B 33/089; H05B 33/083; H05B 33/0887; H05B 33/0821; H05B 33/0824; H05B 33/0884; H05B 33/0893; H05B 37/036; H05B 33/0869; Y02B 20/346; Y02B 20/347; G09G 3/3406; G09G 3/342; G09G 3/3413
USPC ..... 315/307, 224, 186, 185 R, 308, 192, 315/209 R, 123
See application file for complete search history.

(56) References Cited

U.S. PATENT DOCUMENTS 8,593,149 B2 11/2013 Zhang et al.
2007/0195025 A1* 8/2007 Korcharz et al. ..... 345/82
2009/0289559 A1* 11/2009 Tanaka et al. ..... 315/185 R
2010/0219759 A1* 9/2010 Chen ..... 315/129
(Continued)

FOREIGN PATENT DOCUMENTS

CN 102300376 A 12/2011

OTHER PUBLICATIONS

Chinese Office Action dated Mar. 2, 2016 in counterpart Chinese Patent Application No. 201210519210.2 (7 pages in Chinese).

*Primary Examiner* — Alexander H Taningco
*Assistant Examiner* — Seokjin Kim
(74) *Attorney, Agent, or Firm* — NSIP Law

(57) ABSTRACT

A detection circuit configured to detect a short in a plurality of LED arrays is provided. The detection circuit includes a voltage measuring unit, a short detecting unit, and a detection control unit. The voltage measuring unit is configured to measure respective feedback voltages of the plurality of LED arrays and output a lowest measured feedback voltage as a first feedback voltage. The short detecting unit is configured to detect the short in the LED arrays using the measured feedback voltages. The detection control unit is configured to control the short detecting unit to stop short detection operation, when the first feedback voltage exceeds a first preset reference voltage.

20 Claims, 6 Drawing Sheets

(56) References Cited

U.S. PATENT DOCUMENTS

| | | | | |
|---|---|---|---|---|
| 2011/0043114 | A1 | 2/2011 | Hsu et al. | |
| 2011/0050131 | A1* | 3/2011 | Je et al. | 315/297 |
| 2011/0068700 | A1* | 3/2011 | Fan | 315/185 R |
| 2011/0266972 | A1* | 11/2011 | Ling | H05B 33/0827 315/297 |
| 2011/0273101 | A1* | 11/2011 | Liu | 315/192 |
| 2011/0291575 | A1* | 12/2011 | Shiu et al. | 315/192 |
| 2011/0316543 | A1* | 12/2011 | Zhang | H05B 33/0893 324/414 |
| 2012/0074868 | A1* | 3/2012 | Tseng et al. | 315/294 |
| 2012/0286667 | A1* | 11/2012 | Wang | 315/119 |

* cited by examiner

DETECTING CIRCUIT FOR SHORT OF LED ARRAY AND LED DRIVING APPARATUS USING THE SAME

CROSS-REFERENCE TO RELATED APPLICATIONS

This application claims priority from Korean Patent Application No. 10-2011-0130485, filed on Dec. 7, 2011, in the Korean Intellectual Property Office, the disclosure of which is incorporated herein by reference in its entirety.

BACKGROUND

1. Field of the Invention

The following description relates to apparatuses to detect a short in an LED array and an LED driving apparatus using the same, and more particularly, to a detecting circuit to accurately detect a short in an LED array and an LED driving apparatus using the same.

2. Description of the Related Art

A liquid crystal display (LCD) is widely used because it is thin and light in weight, and has a lower need for driving voltage and power consumption when compared to other displays. However, because the LCD is non-light emitting device that does not emit light itself, the LCD requires a separate backlight to supply light onto a LCD display panel.

Cold cathode fluorescent lamp (CCFL) and light emitting diode (LED) are generally used as the backlight source for the LCD. However, because the CCFL uses mercury, using CCFL causes environmental contamination. In addition, the CCFL has further shortcomings such as slow responsiveness, low color representation, and inadequacy to be used for LCD panels due to being heavy in weight and large dimensions compared to the widely used LCD panels.

In contrast, because the LED does not use environmentally-detrimental substances, the LED is environmentally friendly, and is drivable by impulse. Further, the LED provides good color representation and freedom to change brightness, color temperature, or the like as a user may wish by adjusting luminosity of red, green and blue LEDs. The LED is also appropriate for LCD panels in terms of being light in weight, thin, short, and small product. For the above-mentioned reasons, the LEDs are widely used as the backlight source for LCD panel, or the like.

For a LCD backlight employing LEDs, in order to implement an LED array using a plurality of LEDs connected in series, a driving circuit and a DC-DC converter are needed. The driving circuit provides a constant current to the LED, and the DC-DC converter adjusts electricity to the LED.

The LED array often has a problem of being short after operating for a long time or due to impact. Accordingly, a protection circuit is necessary to detect the short of the LED array.

For example, a protection circuit could be provided to measure feedback voltage ($V_{FB}$) of the LED array to detect the short of the LED array. However, the settling time of the constant current source, which is irrespective of the short of the LED array, or abnormal feedback voltage ($V_{FB}$) due to peak current of the constant current could be detected as the short in the LED array.

FIG. 11 is a waveform of a driving voltage and a feedback voltage according to a conventional LED driving apparatus.

In FIG. 11(*a*), the driving voltage higher than a target voltage is applied to the LED array to turn on all the LED arrays during initial LED driving. In FIG. 11(*b*), high driving voltage is sometimes temporarily applied to the LED array during LED driving. However, the feedback voltage increases as high driving voltage is applied to the LED array. As a result, a protection circuit in the conventional LED driving apparatus erroneously detects such temporary increase of feedback voltage as a short in the LED array.

SUMMARY

Exemplary embodiments of the present inventive concept overcome the above disadvantages and other disadvantages not described above. Also, the present inventive concept is not required to overcome the disadvantages described above, and an exemplary embodiment of the present inventive concept may not overcome any of the problems described above. In accordance with an illustrative example, there is provided a detection circuit to detect a short in LED arrays. The detection circuit includes a voltage measuring unit configured to measure respective feedback voltages of the LED arrays and output a lowest measured feedback voltage as a first feedback voltage; a short detecting unit configured to detect the short in the LED arrays using the measured feedback voltages; and a detection control unit configured to control the short detecting unit to stop the detection of the short when the first feedback voltage exceeds a first preset reference voltage.

The detection control unit is configured to control the short detecting unit to perform the detection of the short when the first feedback voltage is below a second preset reference voltage.

The first and second preset reference voltages are identical to each other.

The first preset reference voltage is greater than the second preset reference voltage.

The first preset reference voltage is greater than the feedback voltage of the LED arrays in a normal operation.

The voltage measuring unit is configured to output the first feedback voltage based on the lowest measured feedback voltage, except for a feedback voltage of the LED array in off state among the LED arrays.

The detection control unit is a comparator configured to output a high signal when the first feedback voltage exceeds the first preset reference voltage.

The detection control unit is a hysteresis comparator configured to output a 'high' signal when the first feedback voltage exceeds the first preset reference voltage, and output a 'low' signal when the first feedback voltage is below a second preset reference voltage, which has a voltage level lower than the first preset reference voltage.

In accordance with a further example, the detection circuit further includes a delay unit configured to delay the first feedback voltage and provide the delayed signal to the detection control unit for a duration that a dimming signal driving the LED arrays is 'on'.

The delay unit includes a delay device configured to delay the dimming signal; an AND gate configured to receive the dimming signal and the delayed dimming signal, and outputs a reduced dimming signal; and a MUX configured to provide the detection control unit with the first feedback voltage for the duration that the reduced dimming signal is 'on'.

The MUX provides the detection control unit with the first feedback voltage for the duration that the output signal of the AND gate is 'high', and provides the detection control unit with zero voltage for the duration that the output signal of the AND gate is 'low'.

In accordance with a further illustrative example, there is provided an LED driving apparatus, includes LED arrays; an LED driving circuit configured to provide the LED arrays with a driving voltage and a constant current, and detect a short in the LED arrays; and a detection unit configured to measure respective feedback voltages of the LED arrays, and control the LED driving circuit to stop the detection of the short of the LED driving circuit, when a first feedback voltage is below a second preset reference voltage, wherein the first feedback voltage is the lowest measured feedback voltage.

The detection unit includes: a voltage measuring unit configured to measure respective feedback voltages of the LED arrays and outputs a lowest measured feedback voltage as a first feedback voltage; and a detection control unit configured to control the LED driving circuit to perform the detection of the short when the detected first feedback voltage is below a second preset reference voltage, and control the LED driving circuit to stop the detection of the short when the first feedback voltage exceeds a first preset reference voltage.

The first preset reference voltage is identical to or greater than the second preset reference voltage.

The first preset reference voltage is greater than the feedback voltage of the LED arrays in a normal operation.

The voltage measuring unit is configured to output the first feedback voltage based on the lowest feedback voltage except for a feedback voltage of the LED array in off state among the LED arrays.

The detection control unit is a comparator configured to output a 'high' signal when the first feedback voltage exceeds the first preset reference voltage.

The detection control unit includes a hysteresis comparator which outputs a 'high' signal when the first feedback voltage exceeds the first preset reference voltage, and outputs a 'low' signal when the first feedback voltage is below a second preset reference voltage, wherein the second present reference voltage includes a voltage level lower than the first preset reference voltage.

The detection unit further includes a delay unit configured to delay the first feedback voltage and provide the delayed signal to the detection control unit for a duration that a dimming signal that drives the LED arrays is 'on'.

The delay unit includes a delay device configured to delay the dimming signal; an AND gate configured to receive the dimming signal and the delayed dimming signal, and output a reduced dimming signal; and a MUX which provides the detection control unit with the first feedback voltage for 'on' interval of the reduced dimming signal.

The MUX provides the detection control unit with the first feedback voltage for the duration that the output signal of the AND gate is 'high', and provides the detection control unit with zero voltage for the duration that the output signal of the AND gate is 'low'.

The LED driving apparatus further includes a control unit configured to stop an operation of the LED driving circuit when the short at the LED arrays is detected.

According to an embodiment, the detection unit can accurately detect the short of the LED array because the detection unit does not detect the short of the LED array during the duration of abnormal feedback voltage.

BRIEF DESCRIPTION OF THE DRAWINGS

The above and/or other aspects of the present inventive concept will be more apparent by describing certain exemplary configurations of the present inventive concept with reference to the accompanying drawings, in which.

DETAILED DESCRIPTION

Figure 1:
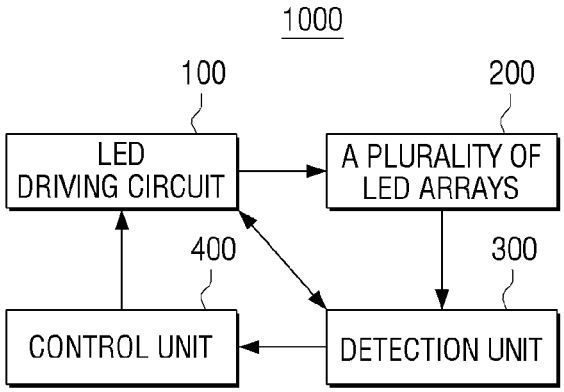
FIG. 1 is a block diagram of an LED driving apparatus, according to an illustrative configuration.

Certain exemplary embodiments of the present inventive concept will now be described in greater detail with reference to the accompanying drawings.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness. Throughout the drawings and the detailed description, unless otherwise described, the same drawing reference numerals will be understood to refer to the same elements, features, and structures. The relative size and depiction of these elements may be exaggerated for clarity, illustration, and convenience.

It will be understood that when an element is referred to as being "on," "connected to," or "operatively connected to" another element or unit, it can be directly on or connected to another element or unit through intervening elements or units. In contrast, when an element is referred to as being "directly on" or "directly connected to" another element or layer, there are no intervening elements or layers present. Like reference numerals refer to like elements throughout. As used herein, the term "and/or" includes any and all combinations of one or more of the associated listed items. The units described herein may be implemented using hardware components. The hardware components may include, for example, controllers, processors, generators, drivers, resistors, filters, metal-oxide-semiconductor field-effect transistor (MOSFETs), metal-insulator-semiconductor FET (MISFETs), operational amplifiers, switches, metal-oxide-semiconductors (MOSs), and other equivalent electronic components.

FIG. 1 is a block diagram of an LED driving apparatus, according to an illustrative configuration.

Referring to FIG. 1, an LED driving apparatus 1000 may include an LED driving circuit 100, a plurality of LED arrays 200, a detection unit 300, and a control unit 400. The LED driving apparatus 1000 may be an image display apparatus such as a monitor, a digital TV, a laptop computer, a mobile phone, a MP3 player, or PMP.

The LED driving circuit 100 receives a dimming signal to drive the plurality of LED arrays 200 and provides the plurality of LED arrays 200 with a driving voltage and a driving current according to the dimming signal. The detailed constitution of the LED driving circuit 100 will be explained below with reference to FIG. 2.

The plurality of LED arrays 200 includes a plurality of parallel-connected LED arrays in which LEDs for light emission are connected in series.

The detection unit 300 measures the feedback voltages of the plurality of LED arrays, respectively. When at least one of the measured feedback voltage is lower than a preset reference voltage, the detection unit 300 detects a short in the plurality of LED arrays. The detailed constitution and operation of the detection unit 300 will be explained below with reference to FIGS. 4 to 10.

As an illustrative example, the control unit 400 controls the respective components in the LED driving apparatus 1000. To be specific, the control unit 400 generates a dimming signal to drive the plurality of LED arrays 200 and provides the generated dimming signal to the LED driving circuit 100. The control unit 400 detects the short in the plurality of LED arrays 200, or control the detection unit 300 to detect the short in the plurality of LED arrays 200. In one example, the control unit 400 may directly detect the short in the LED arrays. If the detection unit 300 detects the short in the plurality of LED arrays 200, the control unit 400 stops the operation of the LED driving circuit 100.

The detection unit 300 in the LED driving apparatus 1000, according to an illustrative configuration, does not detect the short in the LED arrays during an abnormal feedback voltage. As a result, the short can be accurately detected in the LED array.

Furthermore, as illustrated in FIG. 1, the LED driving circuit 100 and the detection unit 300 are illustrated and explained as separate components. However, in accordance with another illustrative configuration, the LED driving circuit 100 and the detection unit 300 may be implemented as one single component, i.e., implemented as one single IC. Furthermore, as further illustrated in FIG. 1, the detection unit 300 is illustrated and explained as detecting the short in the LED array. However, in a configuration, the LED driving apparatus 100 may perform the short detection, and the detection unit 300 may be configured to simply determine whether or not to perform the short detection.

Figure 2:
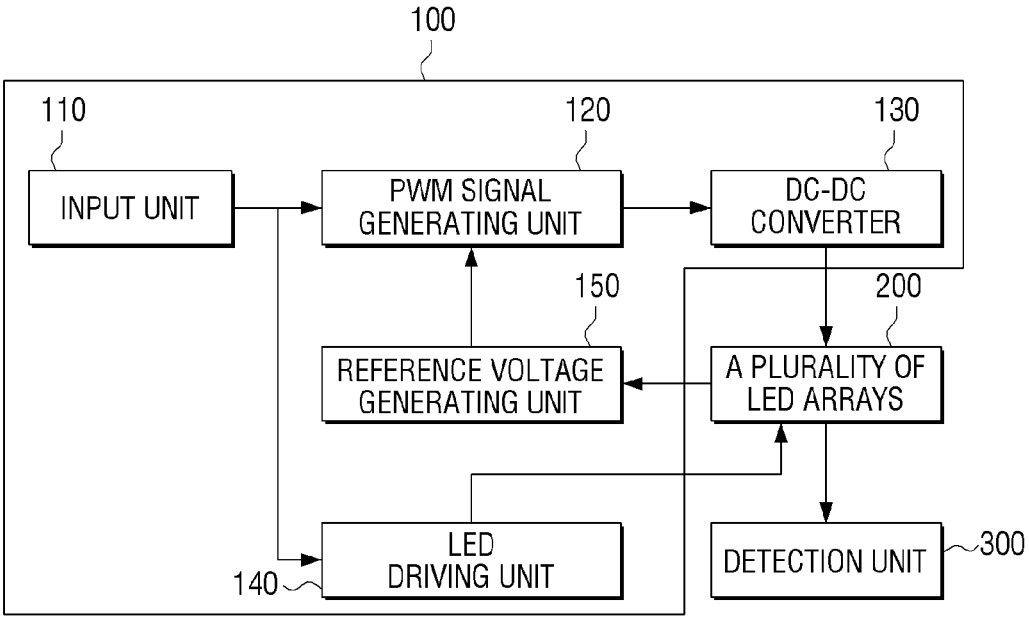
FIG. 2 is a detailed block diagram of the LED driving circuit of FIG. 1.

FIG. 2 is a detailed block diagram of the LED driving circuit of FIG. 1.

Referring to FIG. 2, the LED driving circuit 100 may include an input unit 110, a PWM signal generating unit 120, a DC-DC converter 130, an LED driving unit 140, and a reference voltage generating unit 150.

The input unit 110 receives a dimming signal from the control unit 400 to drive the plurality of LED arrays 200. Specifically, a direct mode, a fixed phase mode and a phase shift mode may be used as digital dimming methods to generate the dimming signal to drive the LED array 200. The direct mode refers to a mode of controlling all the PWM frequency and on-duty signal from outside (for example, a packet assembler/disassembler (PAD)). The fixed phase mode and the phase shift are methods that generate a PWM frequency inside the IC and receive and control only the on-duty signal from the PAD. In one illustrative example, the dimming signal is a signal used to adjust brightness and color temperature of the LED, or to compensate for high temperatures. In the present exemplary configuration, the direct mode, in which dimming signal is input from an external source is discussed. However, that the controller 400 may be configured to use the fixed phase mode and/or the phase shift mode.

The PWM signal generating unit 120 generates a PWM signal according to a reference voltage. To be specific, the PWM signal generating unit 120 generates a PWM signal to control the size of the driving voltage of the DC-DC converter 130 in accordance with a reference voltage generated by the reference voltage generating unit 150.

The DC-DC converter 130 includes a transistor to perform switching, and provides a driving voltage to the plurality of LED arrays 200 in accordance with the switching operation of the transistor. To be specific, the DC-DC converter 130 converts the DC voltage based on the PWM signal generated at the PWM signal generating unit 120, and provides the converted DC voltage (for example, the driving voltage) to the plurality of LED arrays 200. The DC-DC converter 130 provides the plurality of LED arrays 200 with a voltage corresponding to a forward bias voltage of the plurality of LED arrays 200 so that the plurality of LED arrays 200 operate in a saturated region.

The LED driving unit 140 provides constant current to drive the plurality of LED arrays 200 using the dimming signal from the input unit 110. To be specific, the LED driving unit 140 adjusts a size of the driving current to the plurality of LED arrays 200 using the dimming signal, and provides the adjusted constant current (for example, a driving current) to the plurality of LED arrays 200. The detailed configuration and operation of the LED driving unit 140 is explained with reference to FIG. 3.

The reference voltage generating unit 150 generates a reference voltage. To be specific, the reference voltage generating unit 150 measures respective feedback voltages or forward voltages of each of the LED arrays in the plurality of LED arrays 200. The reference voltage generating unit 150 provides a reference voltage corresponding to the LED array having the lowest measured voltage to the PWM signal generating unit 120. In one example, the feedback voltage refers to the voltage of a node that is commonly connected to the LED array and the LED driving unit 140. In the LED array 200 includes a single LED array, the reference voltage generation unit 150 would measure the feedback voltage or the forward voltage of the single LED array and would provide the measured voltage to the PWM signal generation unit 120. In the configuration described above, although the reference voltage generating unit 150 directly measures the feedback voltages and finds the lowest voltage thereof, such configuration is for illustrative purposes only. Accordingly, depending on the configurations, the output value from the voltage measuring unit 310 of the detection unit 300, to be later described, may be utilized.

Figure 3:
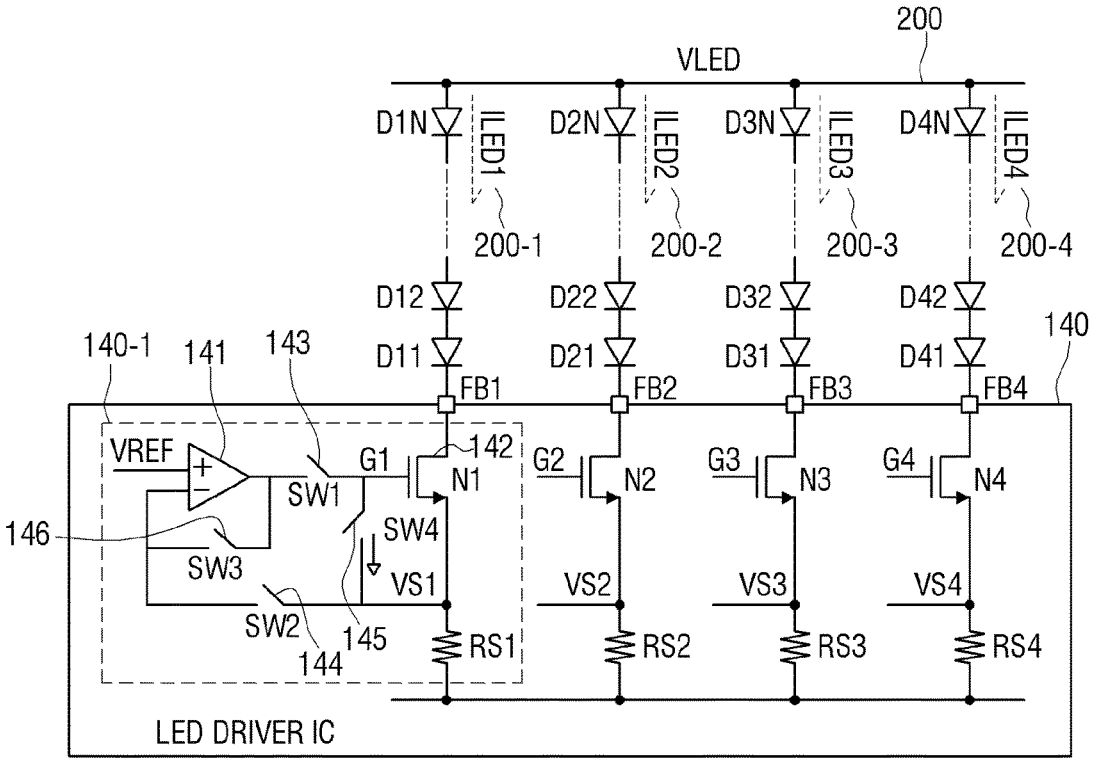
FIG. 3 is a detailed block diagram of the LED driving unit of FIG. 2.

FIG. 3 is a detailed block diagram of the LED driving unit of FIG. 2, in accordance with an illustrative configuration.

Referring to FIG. 3, the LED driving unit 140 may include a comparator 141, a transistor 142, a resistor RS1 and a plurality of switching units 143, 144, 145, 146.

The comparator 141 compares the voltage ($V_{S1}$) of the common node contacting both the transistor 142 and the resistor RS1 with a preset comparison voltage ($V_{REF}$) and controls the transistor 142. To be specific, the comparator 141 may be implemented as an operational amplifier (OP-AMP), in which the positive terminal thereof receives the comparison voltage ($V_{REF}$), the negative terminal receives the voltage ($V_{S1}$) of the common node contacting both the transistor 142 and the resistor RS1. The output end is operatively connected to the gate of the transistor 142 via the first switching unit 143.

The transistor 142 performs a switching operation in accordance with the output signal of the comparator 141 and a connecting status between the plurality of switching units 143, 144, 145, 146. For example, a drain of the transistor 142 is operatively connected to one end of an LED array 200-1, a source is operatively connected to the resistor RS1, and a gate is operatively connected to the output end of the comparator 141 via the first switching unit 143. Meanwhile, although the n-MOS transistor is implemented as the transistor, this is written only for illustrative purposes. Accordingly, in another configuration, other similar types switching devices may be used as a transistor.

One end of the resistor RS1 is connected to the source of the transistor 142 and the other end is grounded.

The plurality of switching units 143, 144, 145, 146 selectively provides the transistor 142 with an output signal of the comparator 141 in accordance with an extended dimming signal.

The first switch 143 is arranged between the comparator 141 and the gate of the transistor 142. The first switch 143 is operatively connected when the dimming signal from the control unit 400 is on and opens when the dimming signal is off.

The second switch 144 is arranged between a common node contacting the source of the transistor 142 and the resistor RS1, and a negative terminal of the comparator 141. The second switch 144 is operatively connected when the dimming signal is on and opens when the dimming signal is off.

The third switch 145 is arranged between a negative terminal of the comparator 141 and an output end of the comparator 141. The third switch 145 opens when the dimming signal is on and is operatively connected when the dimming signal is off.

The fourth switch 146 is arranged between a gate and a ground of the comparator 141. The fourth switch 146 opens when the dimming signal from the control unit 400 is on and is operatively connected when the dimming signal is off.

Accordingly, the first and second switches 143, 144 are operatively connected and the third and fourth switches 145, 146 are open when the dimming signal is on. As a result, the comparator 141 compares the voltage ($V_{S1}$) of the common node contacting both the transistor 142 and the resistor RS1 with a preset comparison voltage ($V_{REF}$) and controls the transistor 142.

In contrast, the first and second switches 143, 144 are open and the third and fourth switches 145, 146 are operatively connected when the dimming signal is off. As a result, the gate of the transistor 142 is operatively connected to the ground, and the transistor 142 blocks a supply of constant current to the LED array 200-1.

Meanwhile, although the LED driving apparatus 1000 illustrated in FIG. 3 includes four LED arrays, other configurations are possible. For example, the plurality of LED arrays may include three or less than three LED arrays, or five or more than five LED arrays. The configuration of FIG. 1 may include as many LED driving units 140 as the LED arrays.

Figure 4:
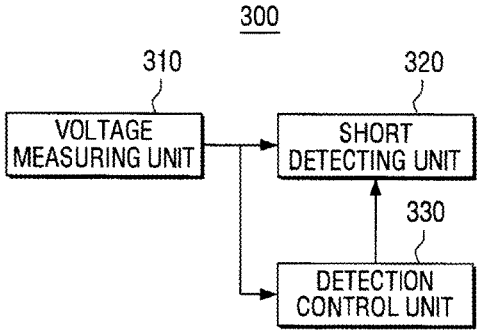
FIG. 4 is a block diagram of a detection unit, according to a first illustrative configuration.
Figure 5:
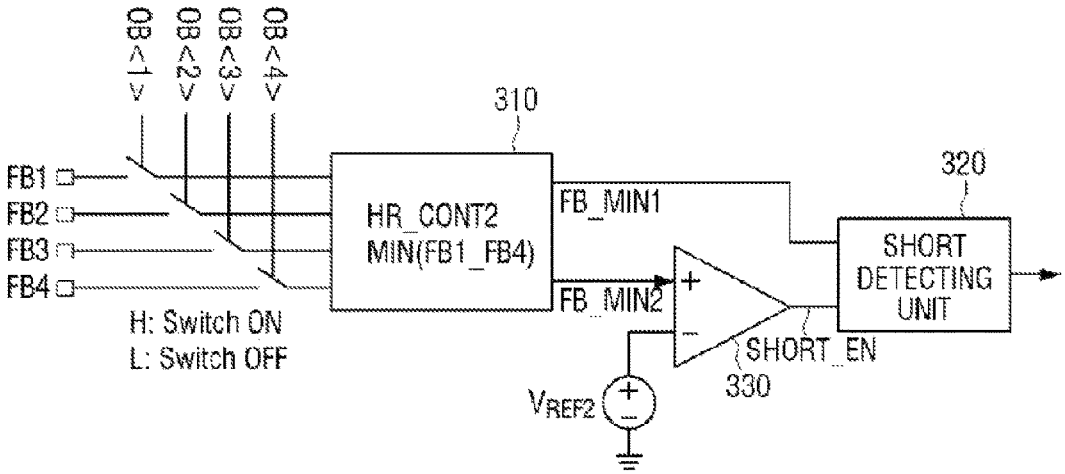
FIGS. 5 and 6 are detailed circuit diagrams of the detection unit, according to the first illustrative configuration.

FIG. 4 is a block diagram of a detection unit according to the first configuration.

Referring to FIG. 4, the detection unit 300 according to the first configuration includes a voltage measuring unit 310, a short detecting unit 320, and a detection control unit 330. In addition, the detection unit 300 according to an illustrative configuration may be implemented as the detection circuit illustrated in FIGS. 5 and 6.

The voltage measuring unit 310 measures the respective feedback voltages of the plurality of LED arrays, and outputs a first feedback voltage as the lowest feedback voltage measured. The voltage measuring unit 310 outputs the first (lowest) feedback voltage, except the feedback voltage of the LED array which is in an off state. According to the configuration illustrated and explained herein, only the lowest feedback voltage is used. However, in another configuration, a second or a third lowest voltage may be used as the feedback voltage.

The short detecting unit 320 detects that the LED array is short when any of the feedback voltages of the plurality of LED arrays exceeds a third preset reference voltage. In one example, the first reference voltage may be greater than the feedback voltage of the LED array in normal operation. A size of the third reference voltage may change depending on the LCD display panel or protection circuit being used. An optimized voltage may be selected as a result of tests conducted by a manufacturer. In one configuration, the short in the LED array is detected using the feedback voltage. Nevertheless, other configurations may be used to detect the short in the LED array. Further, although the short detecting unit 320 is included in the detection unit 300 in the configuration explained above, other examples are possible. For example, the short detecting unit 320 may be provided in the LED driving circuit 100.

The detection control unit 330 determines whether the LED driving circuit 100 is currently supplying abnormal driving voltage to the plurality of LED arrays 200. To be specific, in order to determine whether the abnormal driving voltage is currently supplied, the detection control unit 330 determines whether the first feedback voltage, which has the first lowest voltage value that can be detected by a non-short LED array, has an abnormal value. In other words, the detection control unit 330 may determine whether the detected first feedback voltage exceeds the first preset reference voltage. In one example, the first reference voltage may be greater than the feedback voltage of the LED array in normal operation. The size of the first reference voltage may change depending on the LCD display panel or protection circuit being used. An optimized voltage may be selected as a result of the tests conducted by a manufacturer. In one configuration, the first lowest voltage is used to determine whether the LED driving circuit 100 applies an abnormal driving voltage. However, other examples are also possible. Accordingly, feedback voltages other than the first lowest one may be used.

The detection control unit 330 may control the short detecting unit 320 to stop the detection operation, when the LED driving circuit 100 supplies an abnormal driving voltage to the plurality of LED arrays. The detection control unit 330 controls the short detecting unit 320 to perform the detection operation when a normal driving voltage is supplied to the plurality of LED arrays. Specifically, the detection control unit 330 controls the short detecting unit 320 to perform the short detecting operation, when the detected first feedback voltage is lower than a second preset reference voltage.

The second reference voltage may be equal to the first reference voltage or lower. In other words, referring to FIG. 5, when the second reference voltage is equal to the first reference voltage, the detection control unit 330 may be implemented as a comparator to output a 'high' signal when the first feedback voltage is greater than the first preset reference voltage ($V_{REF1}$) or the second reference voltage ($V_{REF2}$).

Figure 6:
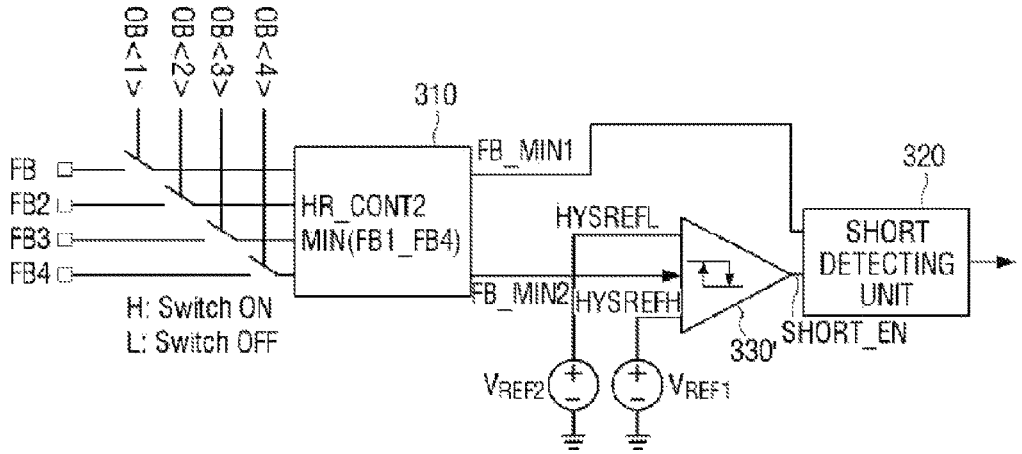

In contrast, referring to FIG. 6, when the second reference voltage ($V_{REF2}$) is lower than the first reference voltage ($V_{REF1}$), the detection control unit 330 may be implemented as a hysteresis comparator to output a 'high' signal when the first feedback voltage is equal to or greater than the first preset reference voltage ($V_{REF1}$), and to output a low signal when the first feedback voltage is lower than a second reference voltage ($V_{REF2}$), which has a lower voltage level than the first preset reference voltage ($V_{REF1}$). In one configuration, a voltage value optimized based on tests conducted by a manufacturer may be selected as the second reference voltage ($V_{REF2}$).

Figure 7:
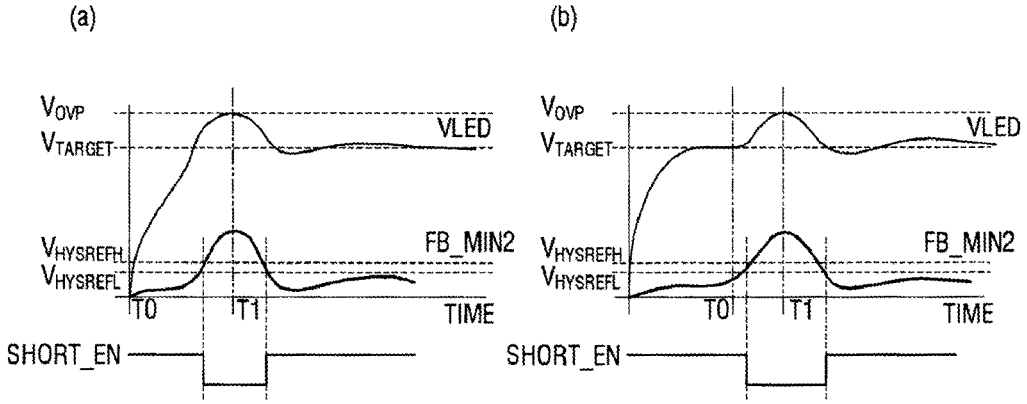
FIG. 7 is a waveform provided to explain an operation of the detection unit of FIG. 4.

FIG. 7 is a waveform provided to explain the operation of the detection unit of FIG. 4.

Referring to FIG. 7, at a point in time that the first feedback voltage exceeds the first preset reference voltage, the control signal (SHORT_EN), which is configured to start the short detection operation, transitions to a low signal. At a point in time that the first feedback voltage decreases below the second preset reference voltage, the control signal (SHORT_EN) transitions to a 'high' signal.

According to an illustrative configuration, the detection unit 300 can accurately detect the short in the LED array, because the detection unit 300 does not detect the short in the LED array during the duration of abnormal feedback voltage.

Figure 8:
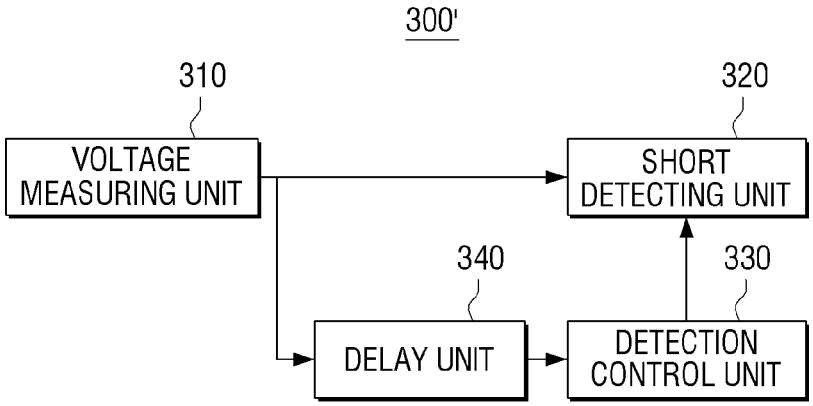
FIG. 8 is a block diagram of a detection unit, according to a second illustrative configuration.

FIG. 8 is a block diagram of the detection unit according to the second configuration.

Referring to FIG. 8, the detection unit 300', according to the second configuration, may include a voltage measuring unit 310, a short detecting unit 320, a detection control unit 330 and a delay unit 340. Compared to FIG. 4, except for the difference in which the detection unit 300' according to the second configuration is additionally provided to the delay unit 340, the remaining configuration is identical to that of the detection unit 300, in accordance with the first configuration. Accordingly, the detailed operations of the voltage measuring unit 310, the short detecting unit 320, and the detection control unit 330 will not be repeated. The detection unit 300', in accordance with the second configuration, may be formed as a delay circuit as the one illustrated in FIG. 9, and may be added to the detection circuit as the one illustrated in FIGS. 5 and 6.

The delay unit 340 is configured to prevent an input with an abnormal first feedback voltage to the detection control unit 330. To be specific, referring to FIG. 10, when dimming signal (PWMI) changes, the feedback voltage (FB) changes instantly to dim a signal 'off' interval. However, it takes a predetermined time for the feedback voltage (FB) to change to a dimming signal 'on' interval.

Accordingly, in order to avoid an occurrence where the abnormal first feedback voltage is provided to the detection control unit 330, the delay unit 340 delays the first feedback voltage for the on-duration of the dimming signal to drive the LED arrays 300, and provides the resultant signal to the detection control unit 330. In one illustrative example, the delay unit 340 may delay the first feedback voltage only for the on-duration of the dimming signal. The detailed configuration and operation of the delay unit 340 will be explained below with reference to FIG. 9.

Figure 9:
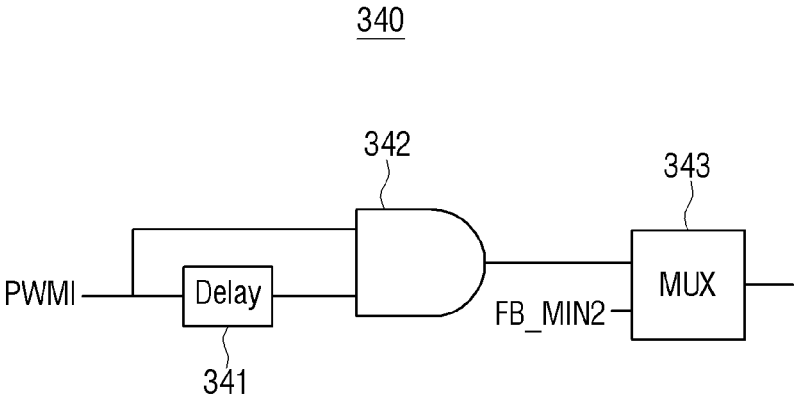
FIG. 9 is a detailed circuit diagram of a delay unit of FIG. 8.
Figure 10:
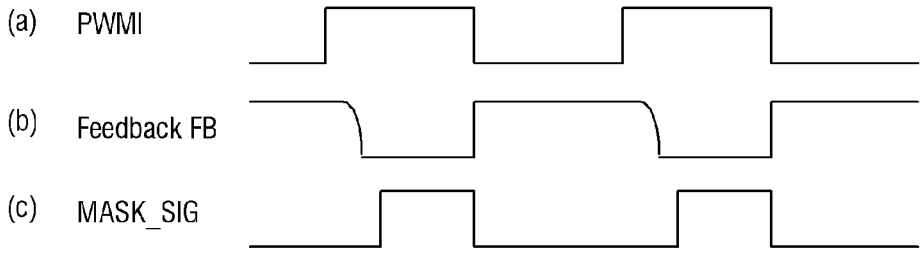
FIG. 10 is a waveform provided to explain an operation of the delay unit of FIG. 8.
Figure 11:
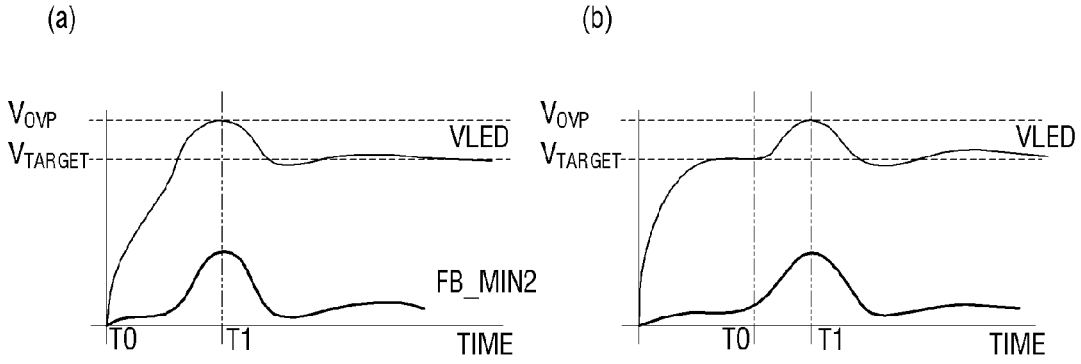
FIG. 11 (PRIOR ART)
FIG. 11 is a waveform of driving voltage and feedback voltage of a conventional LED driving apparatus.

FIG. 9 is a detailed circuit diagram of the delay unit of FIG. 8.

Referring to FIG. 9, the delay unit 340 includes a delay device 341, an AND gate 342 and a MUX 343.

The delay device 341 delays the dimming signal input at the input unit 110. In one example, the delay device 341 may delay the inputted dimming signal within a range between 1 ms and 10 ms.

The AND gate 342 receives the input dimming signal and the delayed dimming signal, and outputs a reduced dimming signal. For example, the AND gate 342 receives the input dimming signal and the output from the delay device 341, and outputs a logic product of the input dimming signal and the delayed dimming signal as a reduced dimming signal. The output waveform from the AND gate 342 is illustrated as signal (MASK_SIG) of FIG. 10.

The MUX 343 provides the detection control unit 330 with the first feedback voltage during a duration that the reduced dimming signal is 'on'. For example, the MUX 343 provides the detection control unit 330 with the first feedback voltage for the duration that the output signal (MASK_SIG) of the AND gate 342 is 'high', and provides the detection control unit 330 with zero (0) voltage for the duration that the output signal (MASK_SIG) of the AND gate 342 is 'low'.

It will be understood that, although the terms first, second, third, etc. may be used herein to describe various elements, components, units and/or sections, these elements, components, units and/or sections should not be limited by these terms. These terms are only used to distinguish one element, component, unit or section from another region, layer or section. These terms do not necessarily imply a specific order or arrangement of the elements, components, regions, layers and/or sections. Thus, a first element, component, unit or section discussed below could be termed a second element, component, unit or section without departing from the teachings description of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A detection circuit to detect a short in LED arrays, the detection circuit comprising:

a voltage measuring unit configured to measure respective feedback voltages of the LED arrays, and to output a first feedback voltage;

a short detecting unit configured to detect the short in the LED arrays, by using the measured feedback voltages; and a detection control unit configured to control the short detecting unit to stop the detection of the short in each of the LED arrays, in response to the first feedback voltage exceeding a first preset reference voltage and to control the short detecting unit to perform the detection of the short, in response to the first feedback voltage being below a second preset reference voltage, the second preset reference voltage being below the first preset reference voltage.

2. The detection circuit of claim 1, wherein the first preset reference voltage is preset to be greater than the first feedback voltage during a normal operation.

3. The detection circuit of claim 1, wherein the voltage measuring unit is configured to output the first feedback voltage, based on a lowest measured feedback voltage among the LED arrays, except for a feedback voltage of an LED array in an 'off' state.

4. The detection circuit of claim 1, wherein the detection control unit comprises a comparator configured to output a high signal, in response to the first feedback voltage exceeding the first preset reference voltage.

5. The detection circuit of claim 1, wherein the detection control unit comprises a hysteresis comparator configured to:

output a 'low' signal, in response to the first feedback voltage exceeding the first preset reference voltage, and output a 'high' signal, in response to the first feedback voltage being below a second preset reference voltage, the second preset reference voltage comprising a voltage level lower than the first preset reference voltage.

6. The detection circuit of claim 1, further comprising:

a delay unit configured to:

delay the first feedback voltage, and provide the delayed signal to the detection control unit, for a duration that a dimming signal to drive the LED arrays is 'on'.

7. The detection circuit of claim 6, wherein the delay unit comprises:

a delay device configured to delay the dimming signal;

an AND gate configured to:

receive the dimming signal and the delayed dimming signal, and output a reduced dimming signal; and a MUX configured to provide the detection control unit with the first feedback voltage, for the duration that the reduced dimming signal is 'on'.

8. The detection circuit of claim 7, wherein the MUX is configured to:

provide the detection control unit with the first feedback voltage, for the duration that the output signal of the AND gate is 'high', and provide the detection control unit with ground voltage, for the duration that the output signal of the AND gate is low'.

9. An LED driving apparatus, comprising:

LED arrays;

an LED driving circuit configured to:

provide the LED arrays with a driving voltage and a constant current; and a detection unit configured to:

measure respective feedback voltages of the LED arrays, and detect a short in the LED arrays; and a detection control unit configured to:

control the detection unit to perform the detection of the short in each of the LED arrays, in response to a first feedback voltage being below a second preset reference voltage; and control the detection unit to stop the detection of the short in each of the LED arrays, in response to the first feedback voltage exceeding a first preset reference voltage, wherein the first preset reference voltage is greater than the second preset reference voltage.

10. The LED driving apparatus of claim 9, wherein the detection unit comprises:

a voltage measuring unit configured to:

measure respective feedback voltages of the LED arrays, and output a lowest measured feedback voltage as a first feedback voltage.

11. The LED driving apparatus of claim 10, wherein the first preset reference voltage is preset to be greater than the first feedback voltage during a normal operation.

12. The LED driving apparatus of claim 10, wherein the voltage measuring unit is configured to output the first feedback voltage, based on the lowest feedback voltage among the LED arrays, except for a feedback voltage of an LED array in an 'off' state.

13. The LED driving apparatus of claim 10, wherein the detection control unit comprises a comparator configured to output a 'low' signal, in response to the first feedback voltage exceeding the first preset reference voltage.

14. The LED driving apparatus of claim 10, wherein the detection control unit comprises a hysteresis comparator configured to output a 'low' signal, in response to the first feedback voltage exceeding the first preset reference voltage, and output a 'high' signal, in response to the first feedback voltage being below a second preset reference voltage, the second preset reference voltage comprising a voltage level lower than the first preset reference voltage.

15. The LED driving apparatus of claim 10, wherein the detection unit further comprises:

a delay unit configured to:

delay the first feedback voltage, and provide the delayed signal to the detection control unit, for a duration that a dimming signal that drives the LED arrays is 'on'.

16. The LED driving apparatus of claim 15, wherein the delay unit comprises:

a delay device configured to delay the dimming signal;

an AND gate configured to:

receive the dimming signal and the delayed dimming signal, and output a reduced dimming signal; and a MUX configured to provide the detection control unit with the first feedback voltage, for the duration of an 'on' interval of the reduced dimming signal.

17. The LED driving apparatus of claim 16, wherein the MUX is configured to provide the detection control unit with the first feedback voltage, for the duration that the output signal of the AND gate is 'high', and provide the detection control unit with ground voltage, for the duration that the output signal of the AND gate is low'.

18. The LED driving apparatus of claim 9, further comprising:

a control unit configured to stop an operation of the LED driving circuit, in response to a detection of a short in the LED arrays.

19. A detection circuit to detect a short in LED arrays, the detection circuit comprising:

a voltage measuring unit configured to measure respective feedback voltages of the LED arrays, and to output a first feedback voltage;

a short detecting unit configured to detect the short in the LED arrays, by using the measured feedback voltages; and a detection control unit configured to enable the short detecting unit to detect the short based on whether:

the first feedback voltage is increasing and is less than a first preset reference voltage, or the first feedback voltage is decreasing and is below a second preset reference voltage, which is lower than the first preset reference voltage.

20. The detection circuit of claim 19, wherein the detection control unit is further configured to, in response to the first feedback voltage exceeding the first preset reference voltage, control the short detecting unit to not detect the short.

* * * * *